US006427350B1

(12) United States Patent
Asaoka et al.

(10) Patent No.: US 6,427,350 B1
(45) Date of Patent: Aug. 6, 2002

(54) TARGET-LENS-SHAPE MEASURING DEVICE, AND EYEGLASS-LENS PROCESSING APPARATUS HAVING THE SAME

(75) Inventors: Toshiaki Asaoka; Yoshinori Matsuyama, both of Aichi (JP)

(73) Assignee: Nidek Co., Ltd., Aichi (JP)

( * ) Notice: Subject to any disclaimer, the term of this patent is extended or adjusted under 35 U.S.C. 154(b) by 106 days.

(21) Appl. No.: 09/684,833

(22) Filed: Oct. 10, 2000

(30) Foreign Application Priority Data

Oct. 7, 1999 (JP) ..... 11-286865

(51) Int. Cl.[7] ..... G01B 7/28
(52) U.S. Cl. ..... 33/507; 33/200
(58) Field of Search ..... 33/200, 507, 551; 73/1.79

(56) References Cited

U.S. PATENT DOCUMENTS

| | | | | |
|---|---|---|---|---|
| 5,138,770 A | | 8/1992 | Matsuyama | 33/28 |
| 5,228,242 A | | 7/1993 | Matsuyama | 51/165.74 |
| 5,333,412 A | | 8/1994 | Matsuyama | 51/165.71 |
| 5,347,762 A | | 9/1994 | Shibata et al. | 451/15 |
| 5,501,017 A | * | 3/1996 | Suzuki | 33/200 |
| RE35,898 E | | 9/1998 | Shibata et al. | 451/5 |
| 5,959,199 A | | 9/1999 | Suzuki et al. | 73/104 |
| 6,006,592 A | | 12/1999 | Suzuki et al. | 73/104 |
| 6,249,991 B1 | * | 6/2001 | Rarick et al. | 33/507 |
| 6,263,583 B1 | * | 7/2001 | Mizuno | 33/200 |

FOREIGN PATENT DOCUMENTS

| | | | |
|---|---|---|---|
| JP | 1-217086 | 8/1989 | C09D/5/24 |
| JP | 3-11526 | 1/1991 | H01J/23/10 |
| JP | 3-20603 | 1/1991 | G01B/5/06 |
| JP | 2907974 | 4/1999 | B24B/9/14 |
| JP | 2918657 | 4/1999 | B24B/9/14 |
| JP | 2925685 | 5/1999 | B24B/9/14 |

* cited by examiner

*Primary Examiner*—G. Bradley Bennett
(74) *Attorney, Agent, or Firm*—Sughrue Mion, PLLC

(57) ABSTRACT

In a target lens shape measuring device for measuring a target lens shape used to process an eyeglass lens, movement of a feeler in a radius vector direction is detected by a first detection system, and movement of a holding base by a moving system is detected by a second detection system. Calibration data is obtained based on the detection result by the second detecting system during the movement of the holding base by the moving system, and the detection result by the first detecting system is calibrated based on the obtained calibration data.

17 Claims, 15 Drawing Sheets

TARGET-LENS-SHAPE MEASURING DEVICE, AND EYEGLASS-LENS PROCESSING APPARATUS HAVING THE SAME

BACKGROUND OF THE INVENTION

The present invention relates to a target-lens-shape measuring device for measuring a target lens shape (a traced outline) of a template (a pattern), a dummy lens, a lens frame of an eyeglass frame, or the like, and an eyeglass-lens processing apparatus having the target-lens-shape measuring device.

In target-lens-shape measuring devices, the target lens shape (the traced outline) is generally measured by detecting the amount of movement of a frame feeler (a stylus) which is brought into contact with a frame groove of a lens frame of an eyeglass frame, or a template feeler (a tracing pin) which is brought into contact with a side surface of a template or dummy lens (hereafter, each of these feelers will be simply referred to as the feeler). A method for detecting the amount of movement of the feeler is carried out in the following manner: A rack-and-pinion mechanism or a mechanism including a wire (or a belt) and pulleys combined together is used to convert the linear movement of the feeler into rotational motion, and the amount of the rotation motion is detected by a rotation detector such as an encoder, thereby obtaining the amount of movement of the feeler.

However, the above-described detection method suffers from a problem in that a deviation may occur between the actual amount of movement of the feeler and the amount of movement of the feeler detected on the basis of an output from the encoder, resulting in an inaccurate result of measurement. Further, the same problem is also applied to the mechanism including the wire (or the belt), and pulleys.

For this reason, calibration is conducted for each device in advance of measurement, and the data obtained through the calibration is stored. However, since the calibration is conducted on the basis of only several pieces of detected data obtained by bringing the feeler into contact with several reference frames differing in size, satisfactory calibration accuracy with respect to linearity cannot be obtained. Further, a special measuring instrument or jig is required to conduct accurate calibration over the entire stroke of the feeler.

SUMMARY OF THE INVENTION

In view of the above-described problems, it is an object of the invention to provide a target-lens-shape measuring device which makes it possible to conduct highly accurate calibration with respect to the amount of movement of the feeler over a wide-ranging stroke without the use of a special measuring instrument or jig. Another object of the invention is to provide an eyeglass-lens processing apparatus having such target-lens-shape measuring device.

The present disclosure relates to the subject matter contained in Japanese patent application No. Hei. Hei. 11-286865 (filed on Oct. 7, 1999), which is expressly incorporated herein by reference in its entirety.

DESCRIPTION OF THE PREFERRED EMBODIMENT

Hereafter, a description will be given of an embodiment of the invention.

(1) Overall Construction

Figure 1:
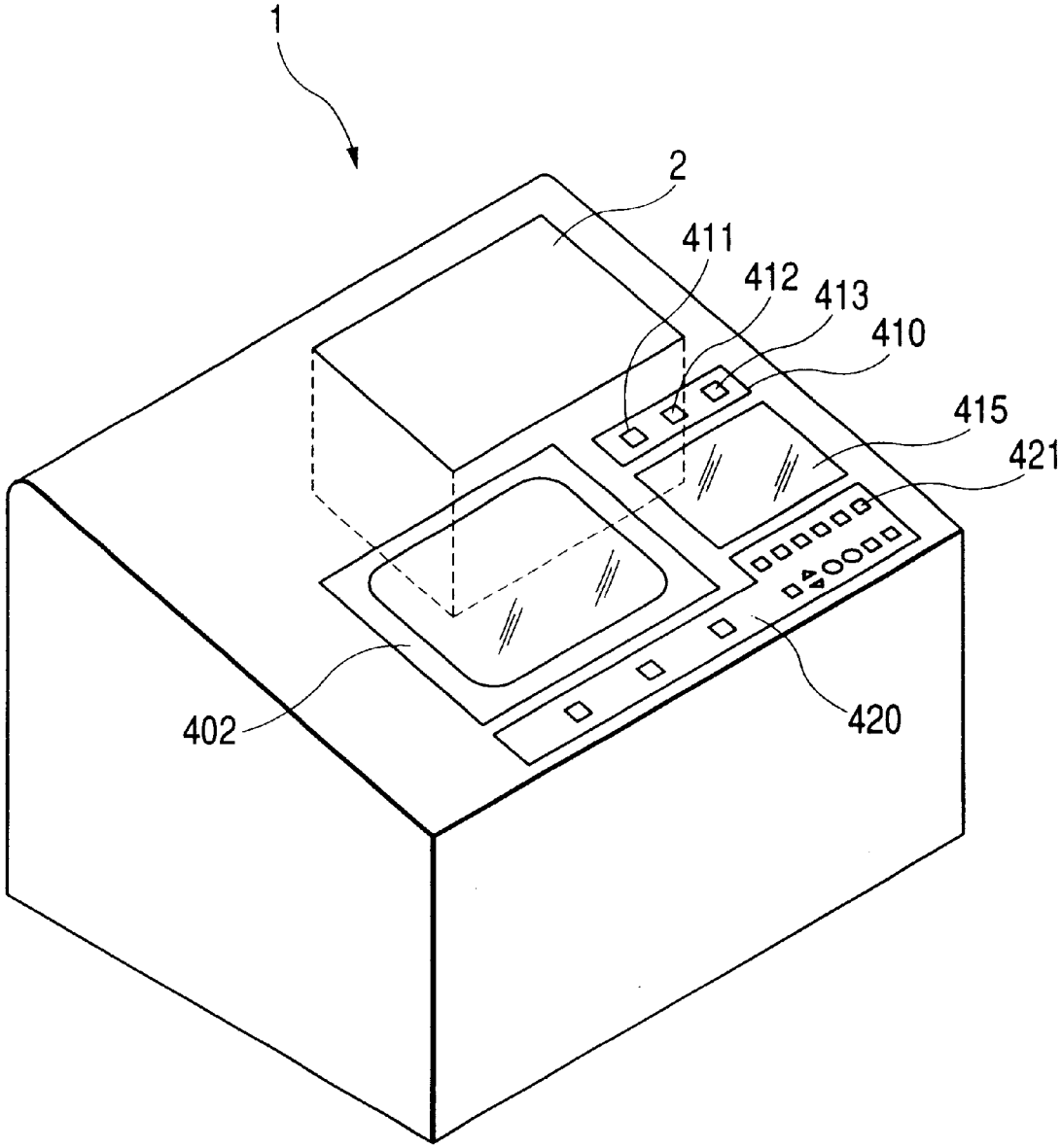
FIG. 1 is a diagram of the external configuration of an eyeglass-lens processing apparatus in accordance with the invention.

FIG. 1 is a diagram illustrating the external configuration of an eyeglass-lens processing apparatus (a lens edger, the same is applied hereafter) in accordance with the invention. A target-lens-shape measuring device, i.e. an eyeglass-frame-shape measuring device (a frame tracer, the same is applied hereafter), 2 is incorporated in an upper right-hand rear portion of a main body 1 of the apparatus. The target-lens-shape measuring device 2 is disposed in such a manner as to be inclined toward a front side along the inclination of the upper surface of the casing of the main body 1 so as to facilitate the setting of an eyeglass frame on a frame holding section 200 which will be described later. A switch panel section 410 having switches for operating the target-lens-shape measuring device 2 and a display 415 for displaying processing information and the like are disposed in front of the target-lens-shape measuring device 2. Further, reference numeral 420 denotes a switch panel section having various switches for inputting processing conditions and the like and for giving instructions for processing, and numeral 402 denotes an openable window for a processing chamber.

Figure 2:
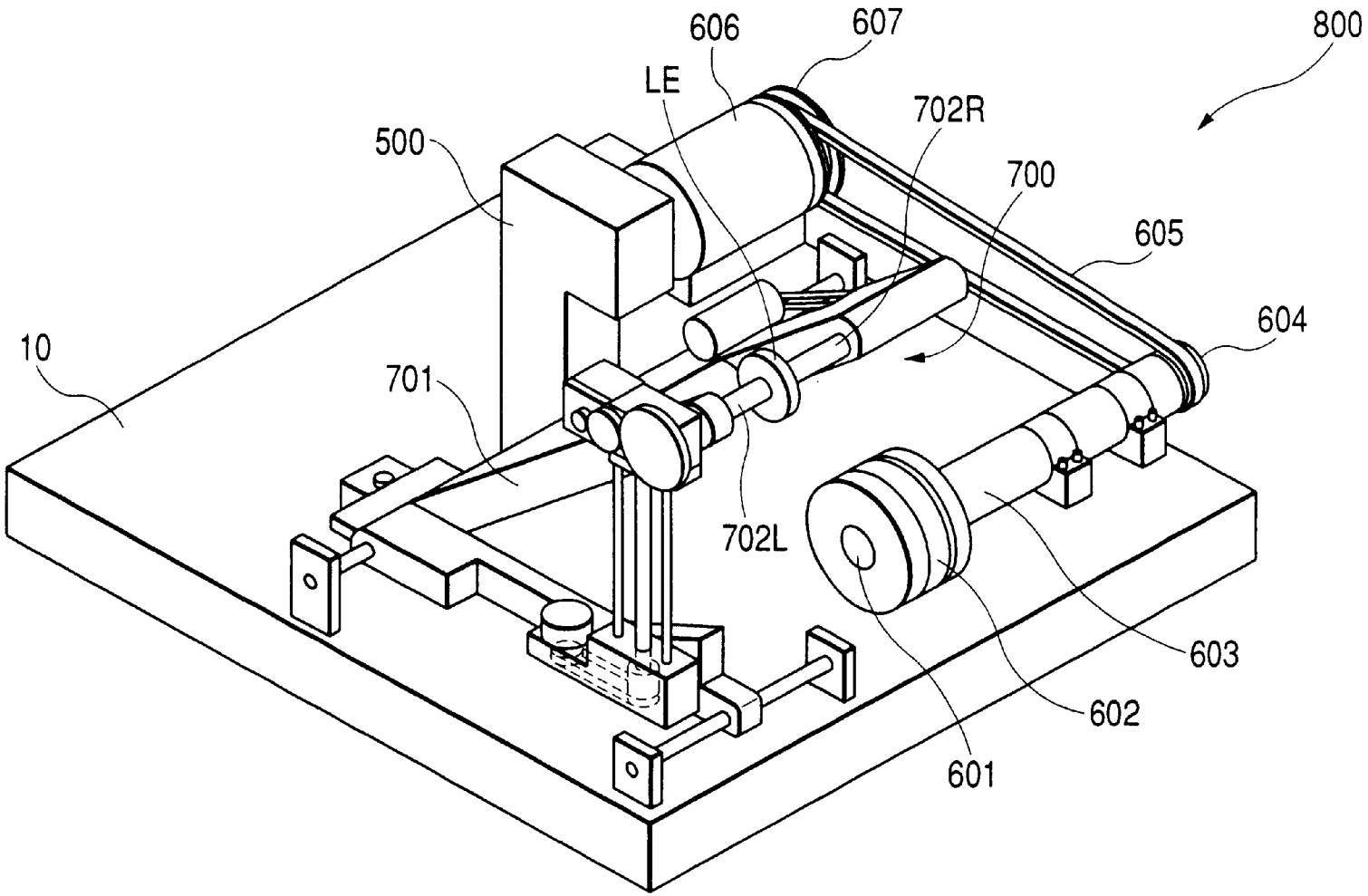
FIG. 2 is a perspective view illustrating the arrangement of a lens processing section disposed in a casing of a main body of the apparatus.

FIG. 2 is a perspective view illustrating the arrangement of a lens processing section 800 disposed in the casing of the main body 1. A carriage unit 700 is mounted on a base 10, and a subject lens LE clamped by a pair of lens chuck shafts 702L and 702R of a carriage 701 is ground by a group of abrasive wheels 602 attached to a rotating shaft 601. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606. The lens LE is subjected to grinding process by variably controlling an axis-to-axis distance between the lens chuck shafts 702L, 702R and the abrasive wheel rotating shaft 601 with a main control section 160 (see FIG. 17). A lens-shape measuring section 500 is provided in the rear of the carriage 701.

(2) Major Construction of Target-Lens-Shape Measuring Device

A description will be given of the major configuration of the target-lens-shape measuring device 2 by dividing it into the frame holding section, a measuring section, and a template holder.

<Frame Holding Section>

Figure 3:
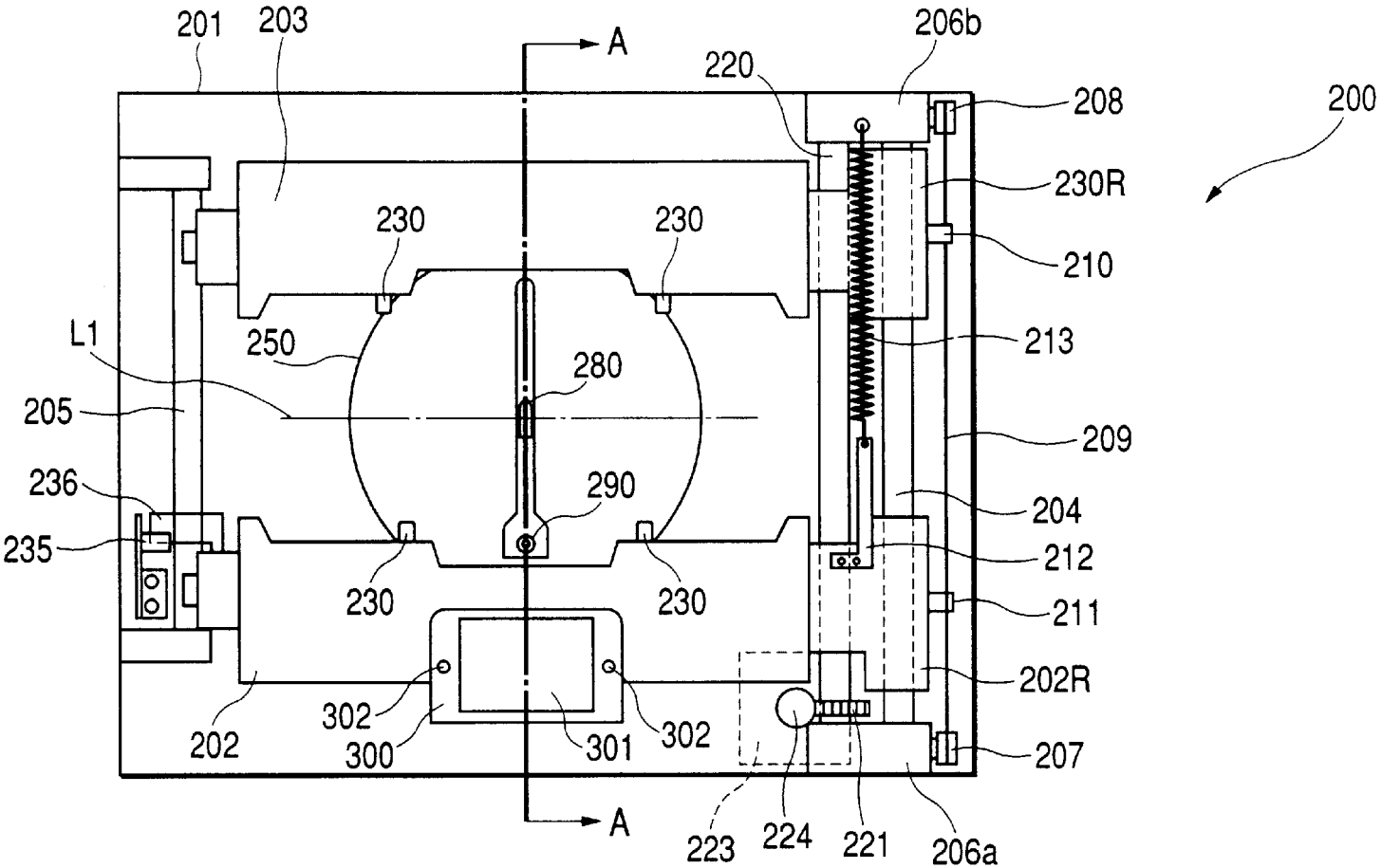
FIG. 3 is a plan view of a frame holding section of a target-lens-shape measuring device.
Figure 4:
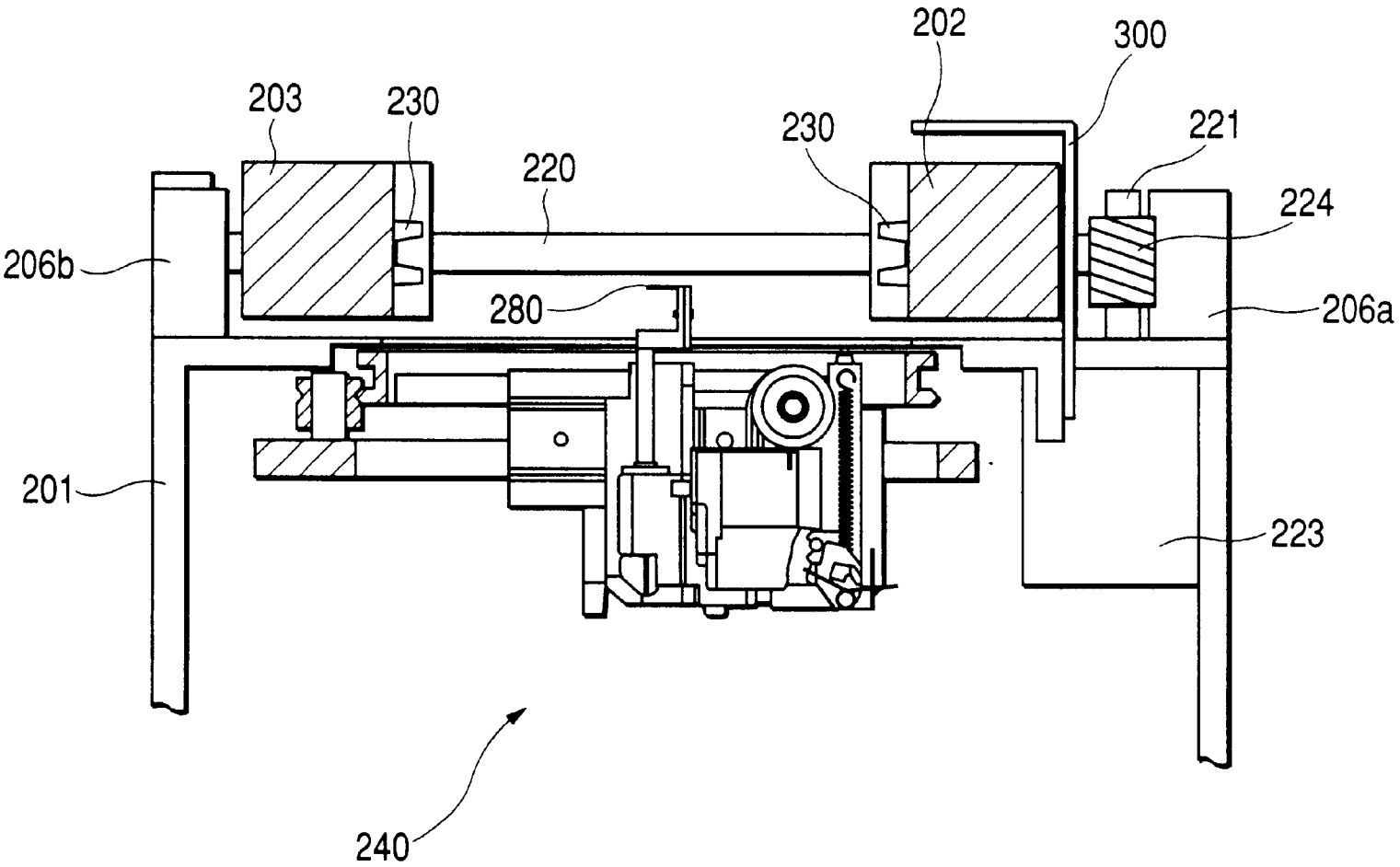
FIG. 4 is a cross-sectional view taken along line A—A in FIG. 3 and illustrating an essential portion.

Referring to FIGS. 3 and 4, a description will be given of the construction of the frame holding section 200. FIG. 3 is a plan view of the frame holding section 200, and FIG. 4 is a cross-sectional view taken along line A—A in FIG. 3 and illustrating an essential portion.

A front slider 202 and a rear slider 203 for holding an eyeglass frame are slidably placed on a pair of guide rails 204 and 205 arranged on the right- and left-hand sides of a holding section base 201. Pulleys 207 and 208 are rotatably attached respectively to a front-side block 206*a* and a rear-side block 206*b* that support the guide rail 204. An endless wire 209 is suspended on the pulleys 207 and 208. An upper side of the wire 209 is secured to a pin 210 attached to a right end member 203R extending from the rear slider 203, while a lower side of the wire 209 is secured to a pin 211 attached to a right end member 202R extending from the front slider 202. Further, a spring 213 is stretched between the rear-side block 206*b* and the right end member 202R using a mounting plate 212, so that the front slider 202 is constantly urged in the direction in which the spring 213 contracts. Owing to this arrangement, the front slider 202 and the rear slider 203 are slid in a symmetrically opposing manner with respect to a reference line L1 at the center therebtween, and are constantly pulled in directions toward that center (reference line L1) by the spring 213. Accordingly, if one of the front slider 202 and the rear slider 203 is slid in the opening direction, a distance therebetween for holding the frame can be secured, and if the front slider 202 and the rear slider 203 are in a free state, the distance therebetween is reduced by the urging force of the spring 213.

The frame is clamped by clamp pins 230 arranged at total four locations, i.e. by clamp pins 230 at right and left two locations of the front slider 202 and clamp pins 230 at right and left locations of the rear slider 203, so as to be held in a reference plane for measurement.

The opening and closing of these clamp pins 230 are effected by driving a clamp motor 223 which is fixed on the reverse side of the holding section base 201. A worm gear 224 attached to a rotating shaft of the motor 223 is in mesh with a wheel gear 221 of a shaft 220 which is rotatably held between the block 206*a* and the block 206*b*, so that the rotation of the motor 223 is transmitted to the shaft 220. The shaft 220 is passed through the right end member 202R and the right end member 203R. Inside the right end member 202R, an unillustrated wire for opening and closing the clamp pins 230 is attached to the shaft 220, and as the wire is pulled by the rotation of the shaft 220, the opening and closing operation of the clamp pins 230 are effected simultaneously. Inside the right end member 203R as well, an unillustrated similar wire is also attached to the shaft 220, and the opening and closing operation of the clamp pins 230 are effected simultaneously by the rotation of the shaft 220. Further, brake pads for securing the opening and closing of the front slider 202 and the rear slider 203 due to the rotation of the shaft 220 are respectively provided inside the right end member 202R and the right end member 203R. As the arrangement of the mechanism for opening and closing the clamp pins 230, it is possible to use the arrangement disclosed in U.S. Pat. No. 5,228,242 commonly assigned to the present assignee, so that reference is had to made thereto for details.

Further, an attaching plate 300 for attaching a template holder 310 (described later), which is used at the time of measuring a template (a pattern, the same is applied hereafter) 350 (or a dummy lens), is fixed at the center on the front side of the holding section base 201 as shown in FIG. 4. The attaching plate 300 has an inverse L-shaped cross section, and the template holder 310 is used upon being placed on the upper surface of the attaching plate 300. A magnet 301 is provided in the center of the upper surface of the attaching plate 300, and two holes 302 for positioning the template holder 310 are formed in the attaching plate 300 on the left- and right-hand sides of the magnet 301.

<Measuring Section>

Figure 5:
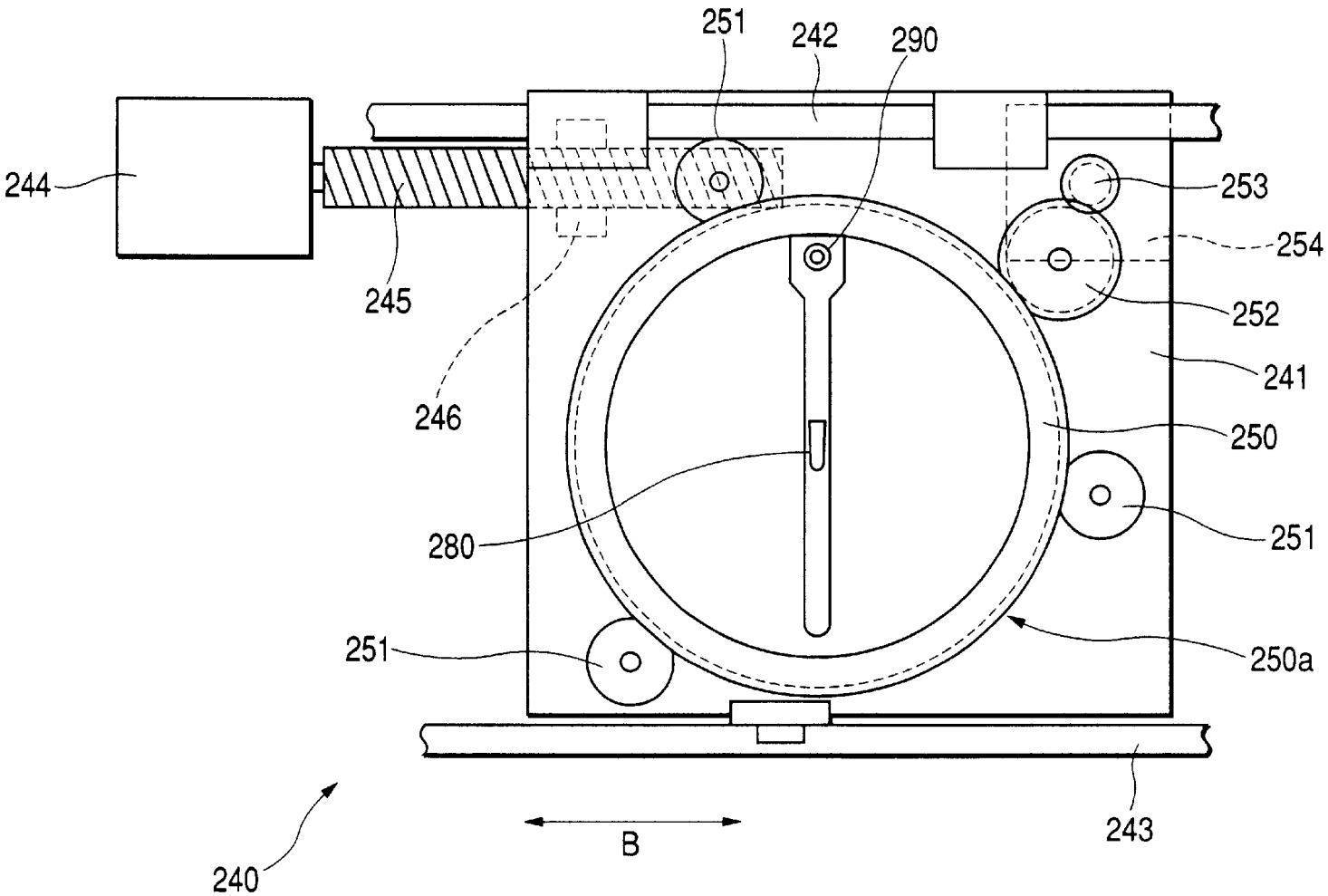
FIG. 5 is a plan view of a measuring section of the target-lens-shape measuring device.
Figure 6:
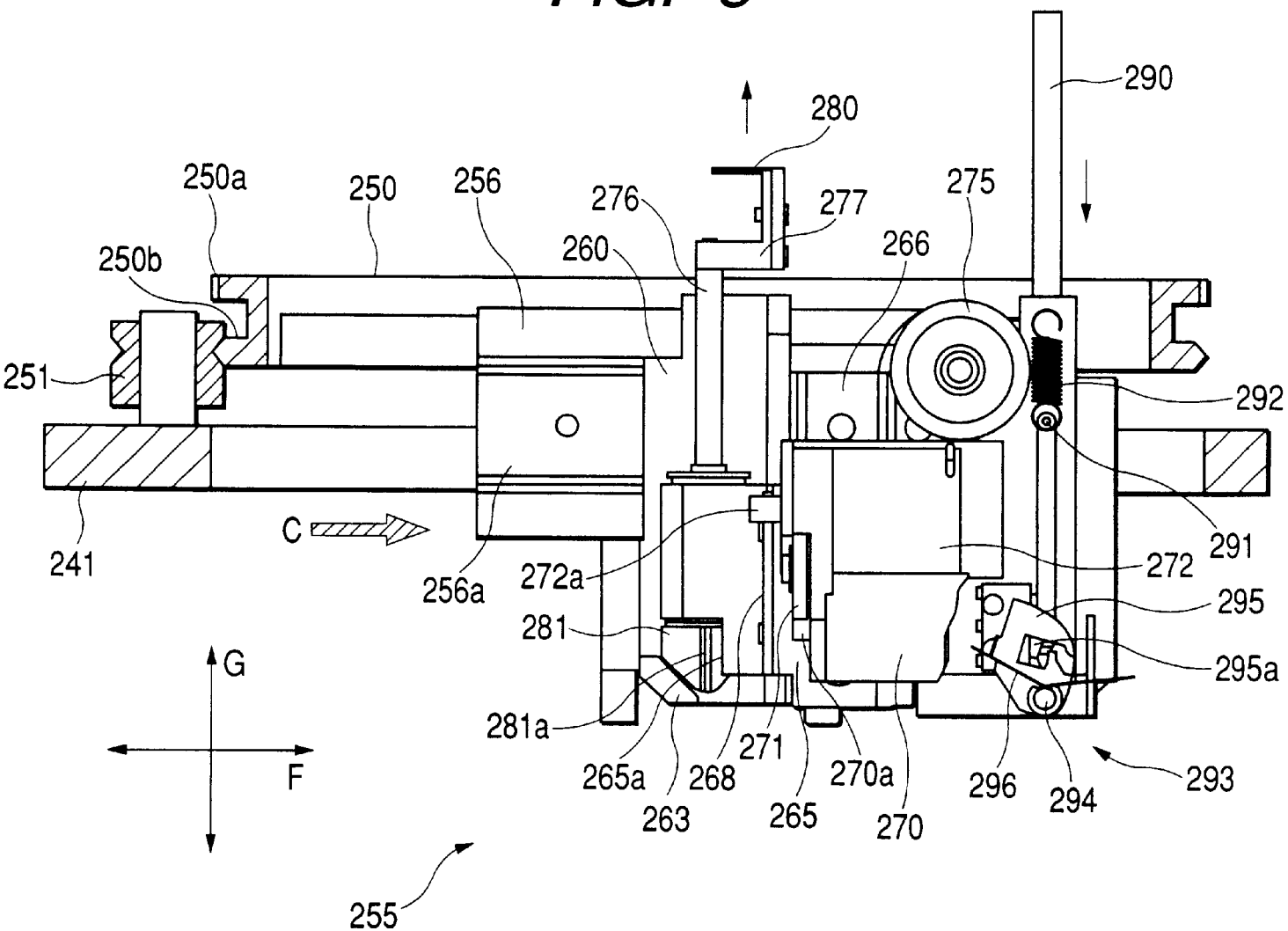
FIG. 6 is a side elevational view for explaining a feeler unit.
Figure 7:
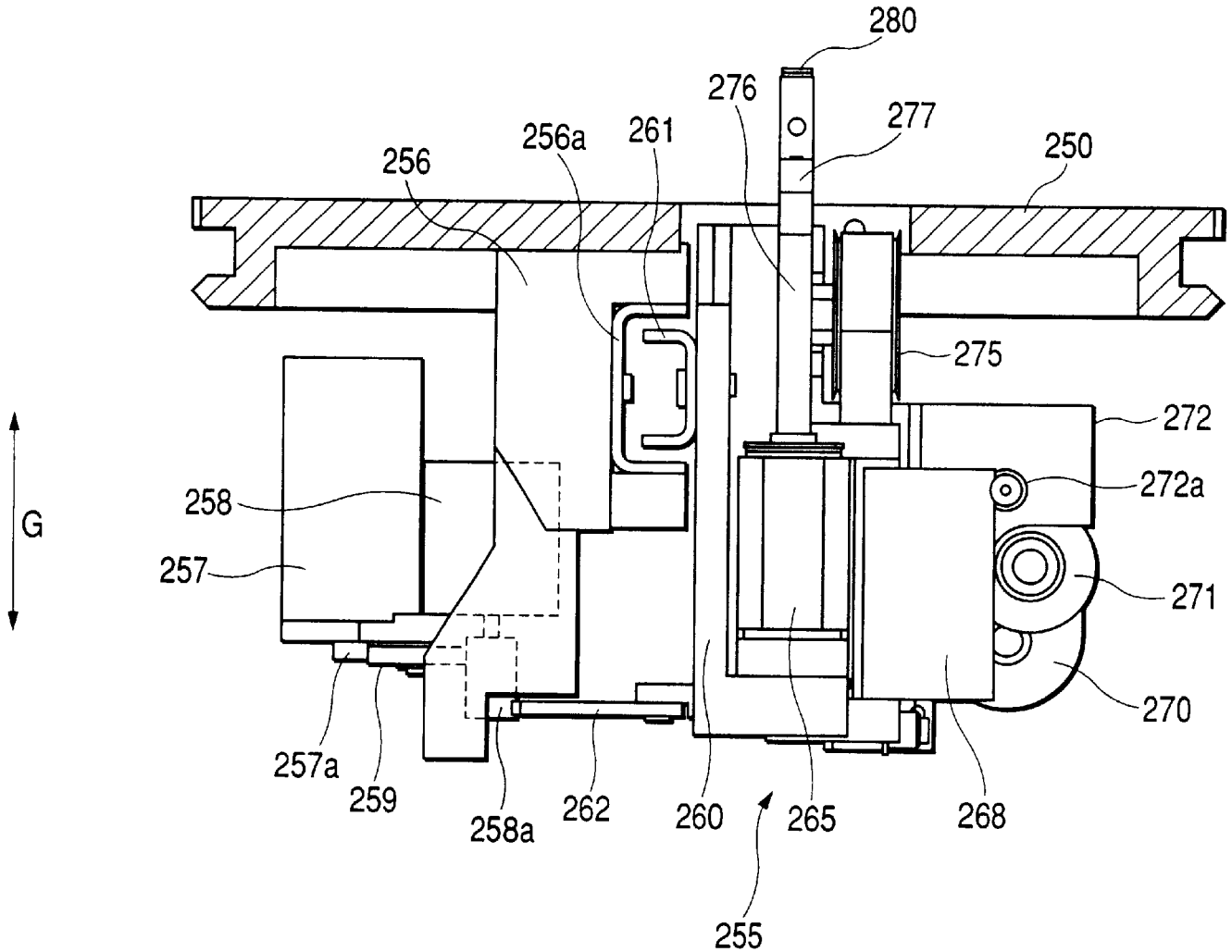
FIG. 7 is a view taken in the direction of arrow C in FIG. 6.

Referring to FIGS. 5 to 7, a description will be given of the construction of the measuring section 240. FIG. 5 is a plan view of the measuring section 240. In FIG. 5, a transversely movable base 241 is supported in such a manner as to be transversely slidable along two rails 242 and 243 which are axially supported by the holding section base 201 and extend in the transverse direction (in the arrow B direction). The transverse movement of the transversely movable base 241 is effected by the driving of a pulse motor 244 attached to the holding section base 201. A feed screw 245 is connected to a rotating shaft of the motor 244, and as the feed screw 245 meshes with a female threaded member 246 fixed on the lower side of the transversely movable base 241, the transversely movable base 241 is moved in the transverse direction (in the arrow B direction) by the forward and reverse rotation of the motor 244.

A rotating base 250 is rotatably held on the transversely movable base 241 by rollers 251 provided at three positions. As shown in FIG. 6, a geared portion 250*a* is formed around a circumference of the rotating base 250, and an angular or tapered guide rail 250*b* projecting in a radially outward direction is formed below the geared portion 250*a*. This guide rail 250*b* is brought into contact with a V-shaped groove of each roller 251, and the rotating base 250 rotates while being held by the three rollers 251. The geared portion 250*a* of the rotating base 250 meshes with an idle gear 252, and the idle gear 252 meshes with a gear 253 attached to a rotating shaft of a pulse motor 254 secured to the lower side of the transversely movable base 241. As a result, the rotation of the motor 254 is transmitted to the rotating base 250. A feeler unit 255 is attached to the underside of the rotating base 250.

Referring to FIGS. 6 and 7, a description will be given of the construction of the feeler unit 255. FIG. 6 is a side elevational view for explaining the feeler unit 255, and FIG. 7 is a view taken in the direction of arrow C in FIG. 6.

A fixed block 256 is fixed to the underside of the rotating base 250. A guide rail receiver 256*a* is attached to a side surface of the fixed block 256 in such a manner as to extend in the planar direction of the rotating base 250. A transversely movable supporting base 260 having a slide rail 261 is attached to the guide rail receiver 256*a* to be slidable in the lateral direction. (in the arrow F direction). A DC motor 257 for moving the transversely movable supporting base 260 and an encoder 258 for detecting the amount of its movement are attached to a side of the fixed block 256 which is opposite to its side where the guide rail receiver 256*a* is attached. A gear 258*a* attached to a rotating shaft of the encoder 258 meshes with a rack 262 fixed to a lower portion of the transversely movable supporting base 260 so that the amount of the movement of the transversely movable supporting base 260 is detected based on the rotation thereof. The rotation of a gear 257*a* attached to the rotating shaft of the motor 257 is transmitted through an idle gear 259 to the gear 258*a* to move the rack 262, thereby moving the transversely movable supporting base 260 in the lateral direction (in the arrow F direction) in FIG. 6.

A vertically movable supporting base 265 is supported by the transversely movable supporting base 260 to be movable in the vertical direction (in the arrow G direction). As for the moving mechanism of the vertically movable supporting base 265, in the same way as the transversely movable supporting base 260, a slide rail (not shown) attached to the vertically movable supporting base 265 is slidably held on a guide rail receiver 266 attached to the transversely movable supporting base 260 and extending in the vertical direction. A vertically extending rack 268 is secured to the vertically movable supporting base 265, and a gear 272*a* of an encoder 272 attached to the transversely movable supporting base 260 by means of a fixing metal plate meshes with the rack 268. With this arrangement, the amount of the movement of the vertically movable supporting base 264 is detected by the encoder 272. The rotation of a gear 270*a*, which is attached to a rotating shaft of a DC motor 270, is transmitted through an idle gear 271 to the gear 272*a* to move the rack 268, thereby moving the vertically movable supporting base 265 in the vertical direction (in the arrow G direction) Incidentally, a downward load of the vertically movable supporting base 265 is reduced by a power spring 275 attached to the transversely movable supporting base 260, thereby rendering the vertical movement of the vertically movable supporting base 265 smooth.

Further, a shaft 276 is rotatably held on the vertically movable supporting base 265, an L-shaped attaching member 277 is provided at its upper end, and a feeler (a stylus, the same is applied hereafter), i.e. a frame feeler, 280 is fixed to an upper portion of the attaching member 277. The tip of the feeler 280 is aligned with a rotational axis of the shaft 276, and the tip of the feeler 280 is to be brought into contact with a frame groove of the frame.

A limiting member 281 is attached to a lower end of the shaft 276. This limiting member 281 has a substantially hollow cylindrical shape, and a protrusion 281*a* is formed on its side surface along the vertical direction (the arrow G direction), while another protrusion 281*a* is formed on the opposite side opposite with respect to the paper surface of FIG. 6. As these two protrusions 281*a* respectively abut against notched surfaces 265*a* (the illustrated notched surface 265*a*, and a similar notched surface 265*a* that is provided on the opposite side with respect to the paper surface of FIG. 6) formed in the vertically movable supporting base 265, the rotation of the shaft 276 (i.e., the rotation of the feeler 280) is limited to a certain range. An obliquely cut slanting surface is formed on a lower portion of the limiting member 281. When the limiting member 281 is lowered together with the shaft 276 due to the downward movement of the vertically movable supporting base 265, this slanting surface abuts against a slanting surface of a block 263 secured to the transversely movable supporting base 260. As a result, the rotation of the limiting member 281 is guided to the state shown in FIG. 6, thereby correcting the orientation of the tip of the feeler 280.

In FIG. 6, a measuring shaft (a tracing pin, the same is applied hereafter), i.e. a template feeler, 290 for template measurement is held on a right-hand side portion of the transversely movable supporting base 260 to be slidable in the vertical direction (in the arrow G direction). A pin 291 extending toward the paper surface as viewed in FIG. 6 is attached to a lower end of the measuring shaft 290, and a spring 292 is stretched between this pin 291 and an upper portion of the transversely movable supporting base 260, thereby constantly urging the measuring shaft 290 in the upward direction. The pin 291 is provided with a lock mechanism 293. The lock mechanism 293 has a fixing plate 295 which rotates about a shaft 294 as well as a coil spring 296 which urges the fixing plate 295 in the rightward direction in FIG. 6. If the measuring shaft 290 is pushed into the interior of the movable supporting base 260 against the urging force of the spring 292, the pin 291 rotates the fixing plate 295 in the leftward direction in FIG. 6 while abutting against the fixing plate 295. Further, if the measuring shaft 290 is pushed in, the pin 291 is located below the fixing plate 295, and the fixing plate 295 is returned to the right side by the urging force of the coil spring 296. As a result, the pin 291 enters below a notched portion of the fixing plate 295, and the measuring shaft 290 is locked in a state of being accommodated inside the transversely movable supporting base 260. At the time of extracting the measuring shaft 290, the pushing in of the top portion of the measuring shaft 290 causes the pin 291 to be disengaged from the notched portion while being guided by a guide plate 295*a* formed on the fixing plate 295, and the measuring shaft 290 is raised to an upper predetermined position by the urging force of the spring 292.

<Template Holder>

Figure 8:
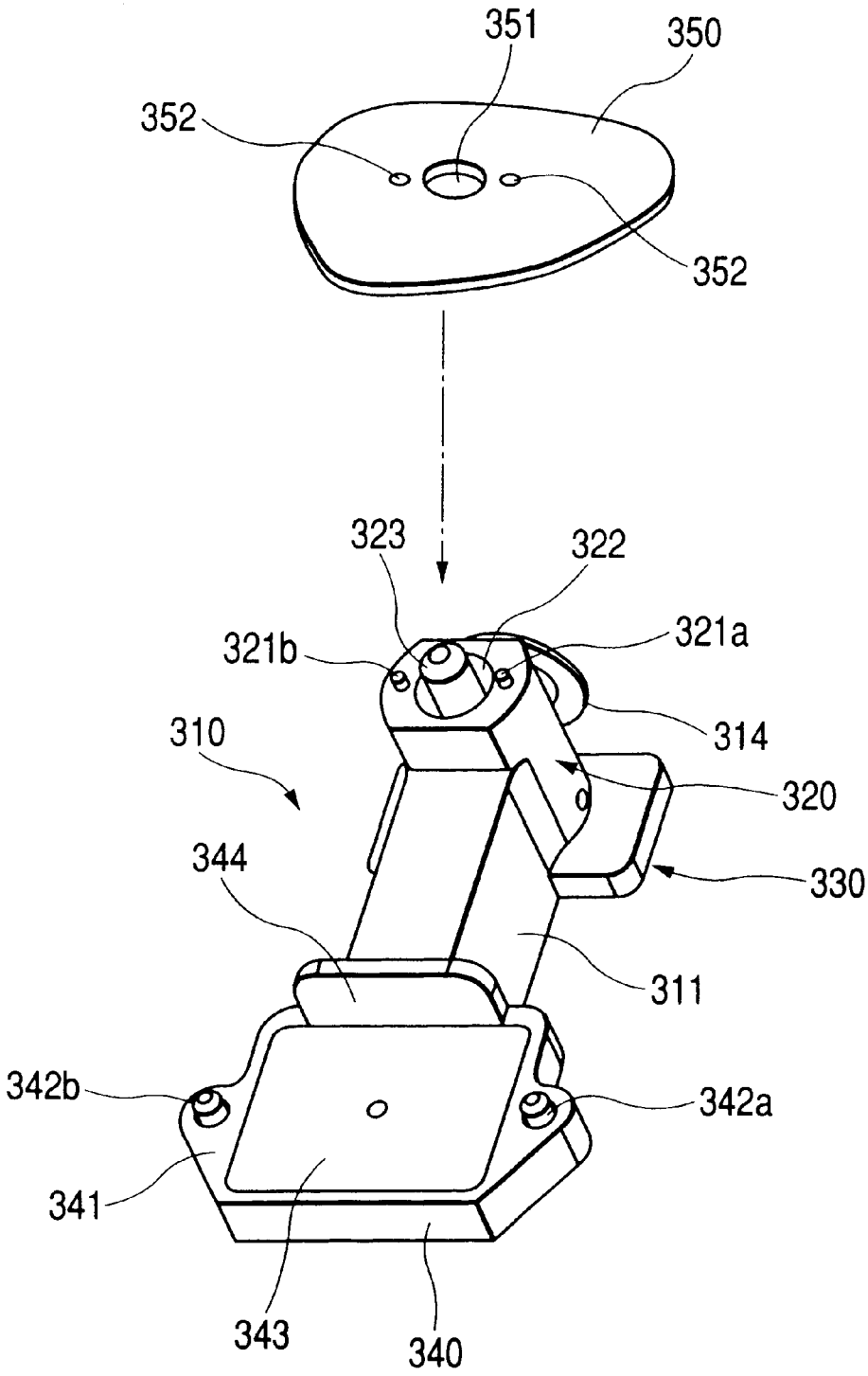
FIG. 8 is a perspective view of a template holder in a state in which a template holding portion for mounting a template thereon is oriented upward.
Figure 9:
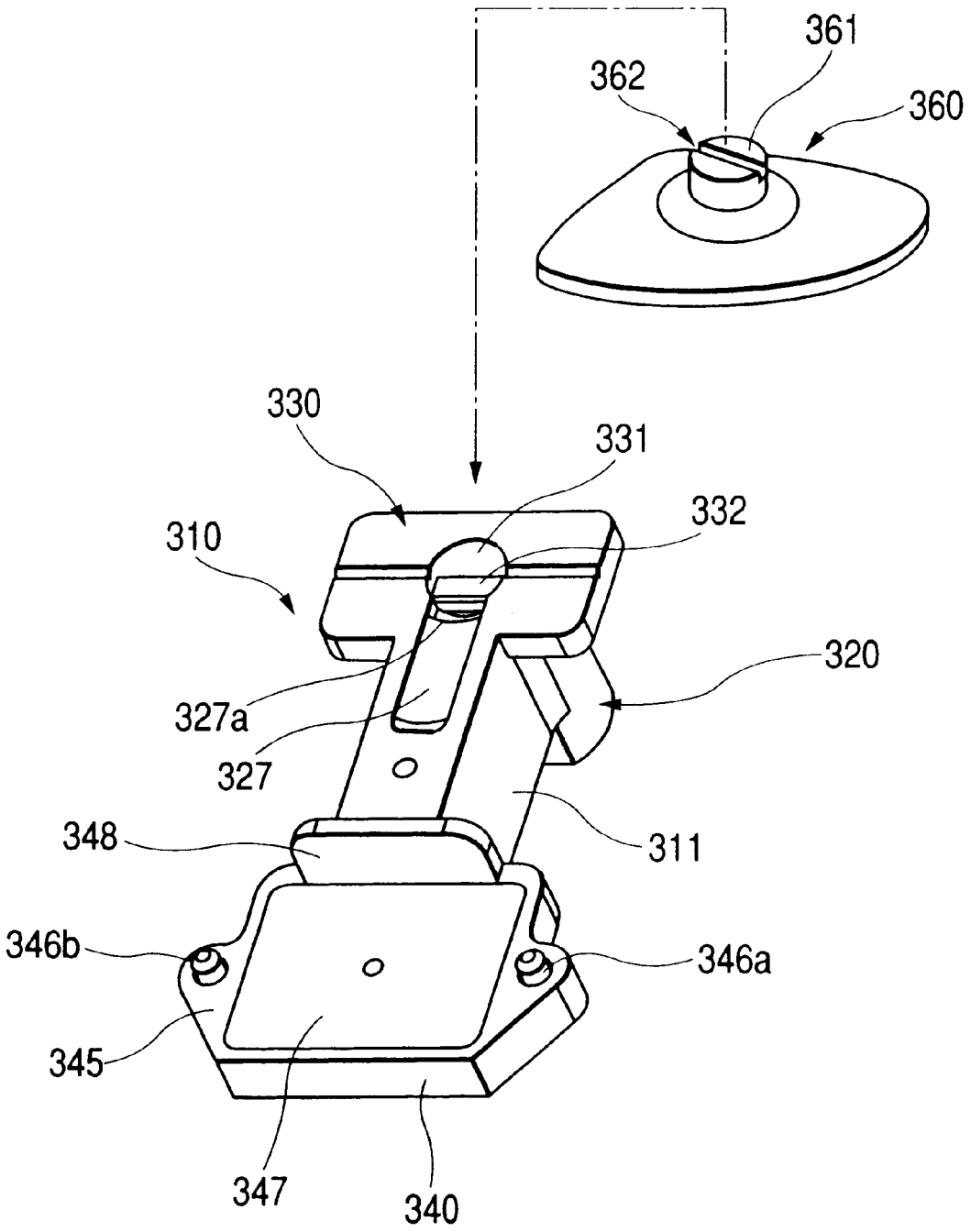
FIG. 9 is a perspective view of the template holder in a state in which a cup holding portion for mounting a dummy lens is oriented upward.
Figure 10:
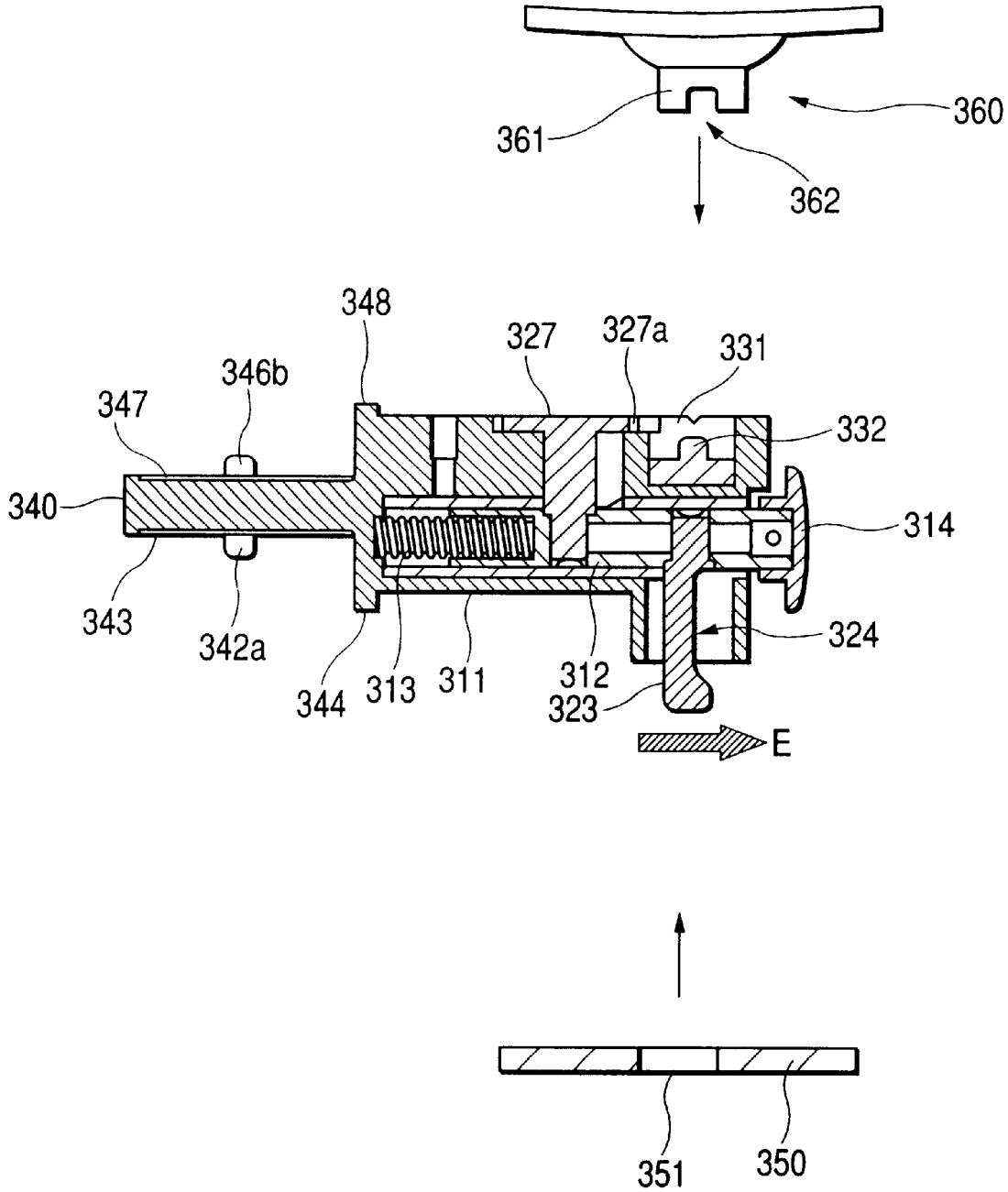
FIG. 10 is a longitudinal cross-sectional view of the template holder.

Referring to FIGS. 8 to 10, a description will be given of the construction of the template holder 310. FIG. 8 is a perspective view of the template holder 310 in a state in which a template holding portion 320 for mounting a template 350 thereon is oriented upward. FIG. 9 is a perspective view of the template holder 310 in a state in which a cup holding portion 330 for mounting a dummy lens thereon is oriented upward. FIG. 10 is a longitudinal cross-sectional view of the template holder 310.

The template holding portion 320 and the cup holding portion 330 are provided integrally on opposite surfaces, respectively, of a main body block 311 of the template holder 310 so that the template holding portion 320 and the cup holding portion 330 can be selectively used by inverting the template holder 310. Pins 321*a* and 321*b* are implanted on the template holding portion 320, an opening 322 is provided in the center, and a movable pin 323 projects from the opening 322. As shown in FIG. 10, the movable pin 323 is fixed to a movable shaft 312 inserted in the main body block 311, and the movable shaft 312 is constantly urged in the direction of arrow E in FIG. 10 by a spring 313. A button 314 for performing a pushing operating is attached to a distal end of the movable shaft 312 projecting from the main body block 311. Further, a recessed portion 324 is formed on the front side (right-hand side in FIG. 10) of the movable pin 323.

A hole 331 for inserting a basal part 361 of a cup 360 with a dummy lens fixed thereon is formed in the cup holding portion 330, and a projection 332 for fitting to a key groove 362 formed in the basal part 361 is formed inside the hole 331. Further, a sliding member 327 is fixed to the movable shaft 312 inserted in the main body block 311, and its front-side end face 327*a* is circular-arc shaped (a circular arc of the same diameter as that of the hole 331).

At the time of fixing the template 350, after the button 314 is manually pushed in, the template 350 is positioned such that a central hole 351 formed in the template 350 is fitted over the movable pin 323 while two small holes 352 provided on both sides of the central hole 351 are engaged with the pins 321*a* and 321*b*. Subsequently, if the button 314 pushed in toward the main body block 311 side is released, the movable pin 323 is returned in the direction of arrow E by the urging force of the spring 313, and its recessed portion 324 abuts against the wall of the central hole 351 in the template 350, thereby fixing the template 350.

At the time of fixing the cup 360 attached to the dummy lens, in the-same way as with the template, after the button 314 is manually pushed in to open the sliding member 327, the key groove 362 of the basal part 361 is fitted to the projection 332. Upon releasing the button 314, the sliding member 327 together with the movable shaft 312 is returned toward the hole 331 by the urging force of the spring 313. As the basal part 361 of the cup 360 inserted in the hole 331 is pressed by the circular-arc shaped end face 327*a*, the cup 360 is fixed in the cup holding portion 330.

A fitting portion 340 for fitting the template holder 310 to the attaching plate 300 of the holding section base 201 is provided on the rear side of the main body block 311, and its obverse side (the template holding portion 320 side is assumed to be the obverse side) has the same configuration as the reverse side. Pins 342*a*, 342*b* and 346*a*, 346*b* for insertion into the two holes 302 formed in the upper surface of the attaching plate 300 are respectively implanted on the obverse surface 341 and the reverse surface 345 of the fitting portion 340. Further, iron plates 343 and 347 are respectively embedded in the obverse surface 341 and the reverse surface 345. Flanges 344 and 348 are respectively formed on the obverse surface 341 and the reverse surface 345 of the fitting portion 340.

At the time of attaching the template holder 310 to the target-lens-shape measuring device 2, after the front slider 202 is opened toward the front side (the rear slider 203 is also opened simultaneously), in the case of the template measurement, the template holding portion 320 side is oriented downward, and the pins 342*a* and 342*b* on the fitting portion 340 are engaged in the holes 302 in the attaching plate 300. At this time, since the iron plate 343 is attracted by the magnet 301 provided on the upper surface of the attaching plate 300, the template holder 310 can be easily fixed immovaly to the upper surface of the attaching plate 300. Further, the flange 344 of the template holder 310 abuts against a recessed surface 202*a* formed in the center of the front slider 202 to maintain the open state of the front slider 202 and the rear slider 203.

(3) Operation in Measurement by Target-Lens-Shape Measuring Device

Figure 17:
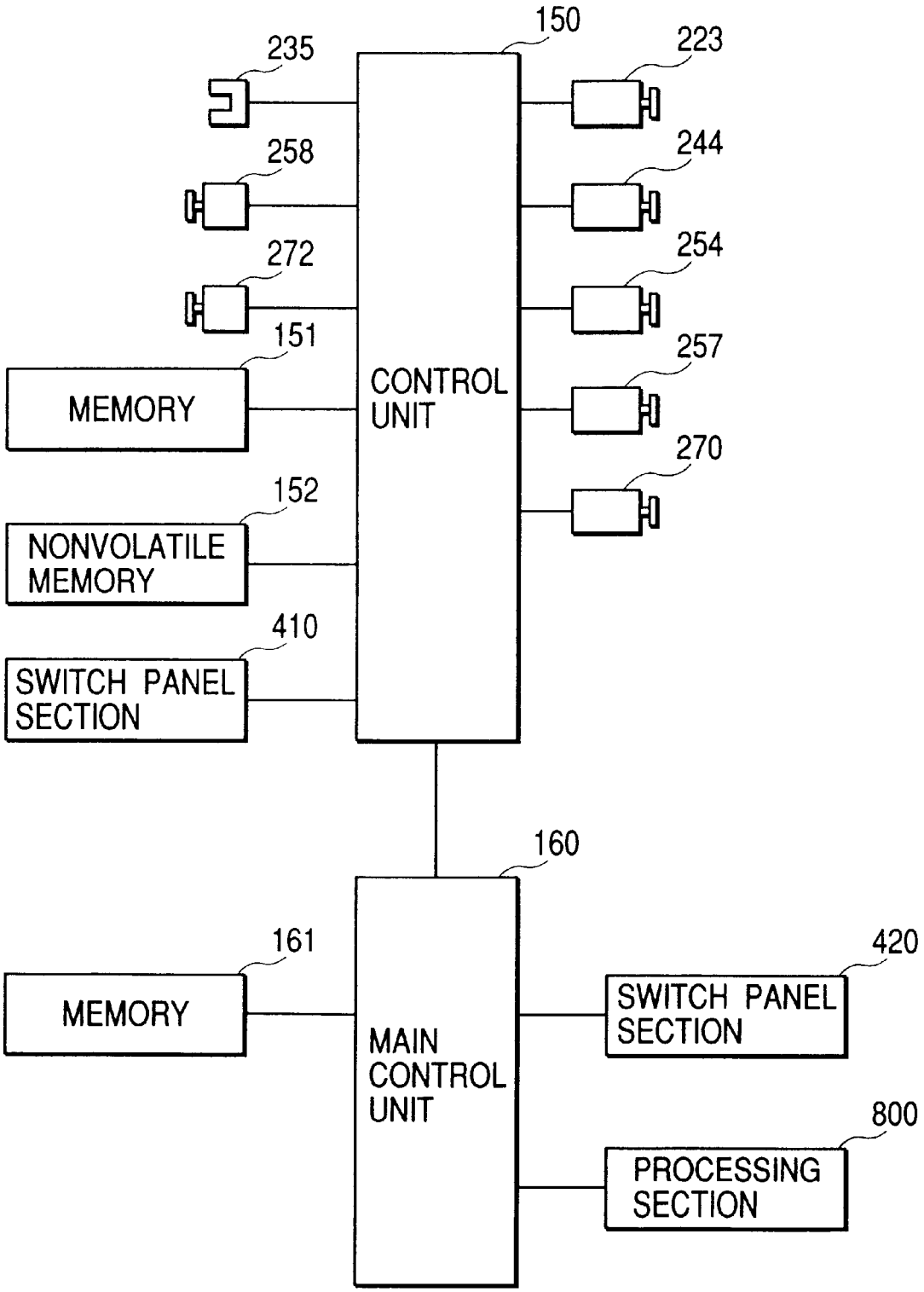
FIG. 17 is a control system block diagram of the apparatus.

Next, referring to the control system block diagram of FIG. 17, a description will be given of the operation of the. target-lens-shape measuring device 2 when a lens frame shape (a target lens shape (a traced outline, the same is applied hereafter)) of the frame is measured (the both-eye-tracing (measurement for both lens frames) is described with reference to the embodiment).

After the front slider 202 is pulled toward the front side (the operator side) to widen the distance between the front slider 202 and the rear slider 203, the frame is placed between the clamp pins 230. Since centripetal forces for moving toward the reference line L1 are constantly acting in the front slider 202 and the rear slider 203 owing to the spring 213, the distance between the two sliders 202 and 203 is thereby narrowed, and the frame is held with the reference line L1 as the center.

Upon completion of the setting of the frame, a both-eye tracing switch 412 of the switch panel section 410 is pressed. Then, a control unit 150 on the target-lens-shape measuring device 2 drives the motor 223, and as the shaft 220 is rotated, the clamp pins at four locations are closed to clamp and fix the frame. Subsequently, the measuring section 240 is operated to measure the target lens shape.

In the case of both-eye tracing, the control unit 150 moves the transversely movable base 241 in advance by driving the motor 244 so that the feeler 280 is located at a predetermined position on the right lens frame portion of the frame. Subsequently, the vertically movable supporting base 265 is raised by driving the motor 270 to allow the feeler 280 to be located at the height of the measurement reference plane. The amount of movement at the time the feeler 280 is raised from a lowest-point position can be obtained from the detection by the encoder 272, and the control unit 150 causes the feeler 280 to be located at the height of the measurement reference plane on the basis of the detection information of the encoder 272.

Subsequently, the control unit 150 drives the motor 257 to move the transversely movable supporting base 260, and thereby allows the tip of the feeler 280 to be inserted in the frame groove of the lens frame. During this movement, since a DC motor is used as the motor 257, the driving current (driving torque) to the motor 257 can be controlled to provide a predetermined driving force. Therefore, it is possible to impart a weak pressing force of such a degree that the frame is not deformed and that the feeler 280 is not dislocated. Subsequently, the motor 254 is rotated in accordance with each predetermined unit number of rotational pulses to rotate the feeler unit 255 together with the rotating base 250. As a result of this rotation, the transversely movable supporting base 260 together with the feeler 280 is moved transversely (in the direction of arrow F) in accordance with the radius vector of the frame groove, and the amount of its movement is detected by the encoder 258. That is, the amount of movement of the feeler 280 in the direction of the radius vector with respect to the target lens shape is detected by the encoder 258.

The vertically supporting base 265 together with the feeler 280 is moved vertically (in the direction of arrow G) along the warp (curve) of the frame groove, and its amount of movement is detected by the encoder 272. The target lens shape of the right lens frame portion is measured as (rn, θn, zn) (n=1, 2, . . . , N) on the basis of the rotation angle θ of the motor 254, the amount r detected by the encoder 258, and the amount z detected by the encoder 272.

Upon completion of the measurement of the right lens frame portion, the control unit 150 drives the motor 244 to move the transversely movable base 241 so that the feeler 280 is located at a predetermined position on the left lens frame portion of the frame, and the target lens shape of the left lens frame portion is measured in a similar manner.

When the operator presses a data switch 421 of the switch panel section 420, the target lens shape data measured as described above is transferred to a data memory 161 on the processing apparatus side, and is used as processing information.

In addition, in the case of the measurement of the template or the dummy lens, the measuring shaft 290 instead of the feeler 280 is used to trace the periphery of the template or the dummy lens, so that the amount of movement of the measuring shaft 290 in the direction of the radius vector is detected by the encoder 258 in the same way as the above-described frame measurement, and the target lens shape of the template is measured on the basis of the amount of movement thus detected and the rotation angle θ of the motor 254.

The template or the dummy lens is mounted to the template holding portion 320 or the cup holding portion 330 of the template holder 310 in the above-described procedure. Upon mounting of the template or the dummy lens to the template holder 310, the front slider 202 is pulled toward the front side, and the template holder 310 is fixed onto the upper surface of the attaching plate 300. Since the flange 344 (348) of the template holder 310 is engaged in the recessed surface 202*a* of the front slider 202, the open state of the front slider 202 and the rear slider 203 is fixed. The open state of the front slider 202 is detected by a sensor plate and a sensor 235 so that the template measurement mode is detected.

After the setting of the template holder 310, in a case where the template (or dummy lens) to be measured is for the right use, a right trace switch 413 on the switch panel section 410 is pressed, whereas in a case where it is for the left use, a left trace switch 411 is pressed. In addition, prior to the measurement using the template holder 310, the apex portion of the measuring shaft 290 is pressed to raise the measuring shaft 290.

The control unit 150 drives the motor 244 to position the transversely movable base 241 at the measuring position in the center. Subsequently, the motor 257 is driven to move the transversely movable supporting base 260 such that the measuring shaft 290 is oriented toward the central side. In a state in which the measuring shaft 290 abuts against the end face of the template (or the dummy lens), the motor 254 is rotated in accordance with each predetermined unit number of rotational pulses to rotate the feeler unit 255. The measuring shaft 290 is moved in accordance with the radius vector of the template, and the amount of its movement is detected by the encoder 258.

(4) Calibration of Target-Lens-Shape Measuring Device

As described above, in order to measure the target lens shape, the amount of movement of the feeler (the feeler 280 or the measuring shaft 290) in the radius vector direction is obtained on the basis of the output signal (number of pulses) from the encoder 258. However, the accuracy of the obtained amount largely depends on the processing accuracy (structural precision) of the gear 258*a* attached to the rotating shaft of the encoder 258 as well as the rack 262. In particular, if the axis of the gear 258*a* is eccentric to the rotating shaft of the encoder 258, a periodically changing error is contained in the detected amount of movement of the transversely movable supporting base 260. This hinders measurement of the target lens shape with high accuracy.

The moving mechanism using the feed screw is generally capable of realizing high-accuracy movement at remarkably lower cost as compared with the moving mechanism using the rack and the gear (pinion). Accordingly, in the present device, the linearity calibration with respect to the amount of movement of the transversely movable supporting base 260 (the feeler 280 and the measuring shaft 290) is conducted using the movement of the transversely movable base 241 by the feed screw 245. Hereafter, a description will be given of this calibration with reference to FIGS. 11 to 16.

Figure 11:
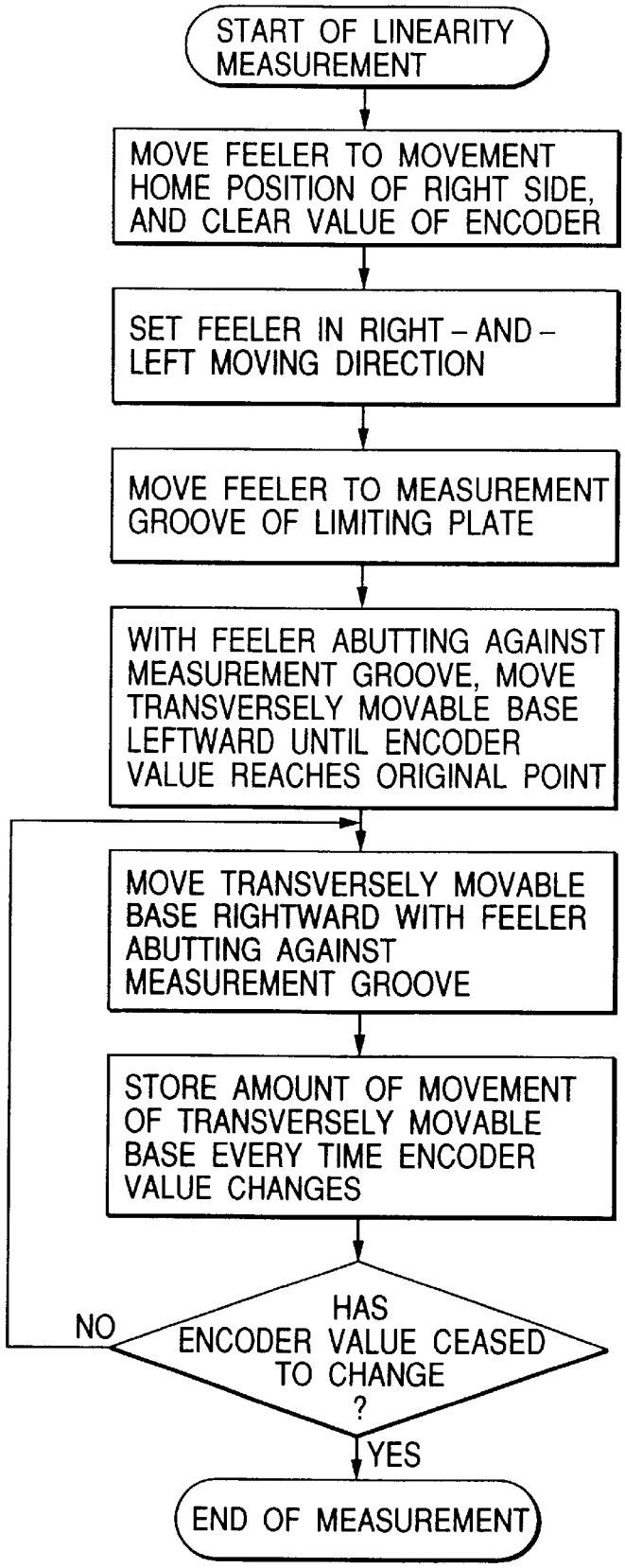
FIG. 11 is a diagram explaining the flow of linearity calibration.

FIG. 11 is a diagram explaining the flow of the linearity calibration. FIG. 12 is a diagram explaining the operation of the linearity calibration.

In FIG. 12, reference numeral 901 denotes a limiting plate for limiting the movement of the feeler 280 in the leftward direction (in the B1 direction) of FIG. 12. The limiting plate 901 has a shape modeled like an eyeglass frame in order to enable the calibration with respect to the entire target lens shape. A measurement groove 901*a* is provided to the reverse side of the limiting plate 901 in a central portion thereof to provide to a step portion. The calibration is conducted with the feeler 280 kept in abutment against the measurement groove 901*a*.

In advance of the calibration, the limiting plate 901 is clamped and fixed by the clamp pins 230 in the similar manner to the case where the frame is fixed. Next, through the switching operation on the switch panel section 410 (the operation of simultaneously pressing the three switches 411, 412, and 413), a program for calibration preliminarily stored in the control unit 150 is executed.

Figure 12A:
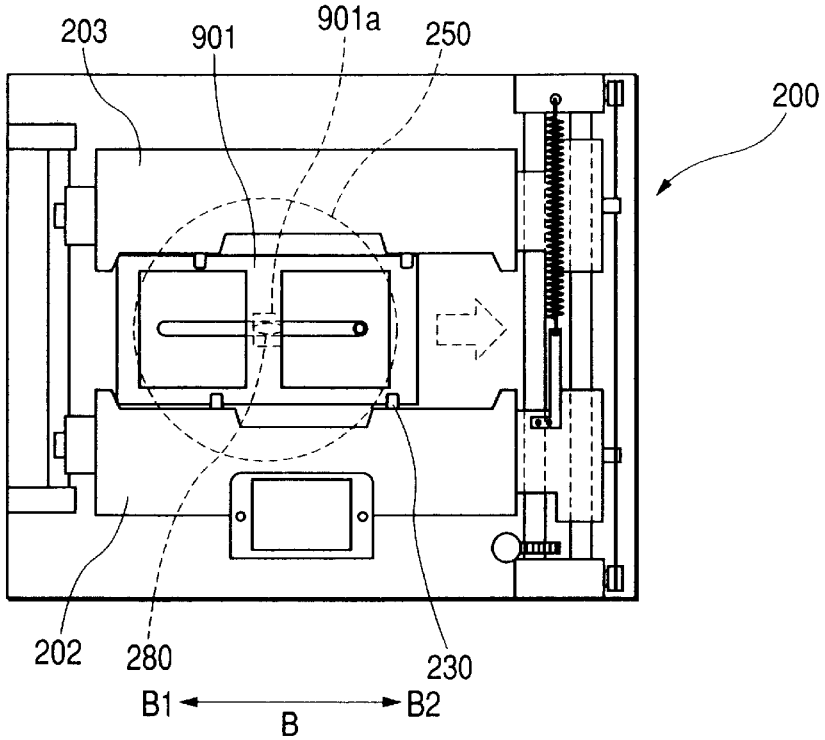
FIGS. 12(*a*) and 12(*b*) are diagrams explaining the operation of the linearity calibration.
Figure 12B:
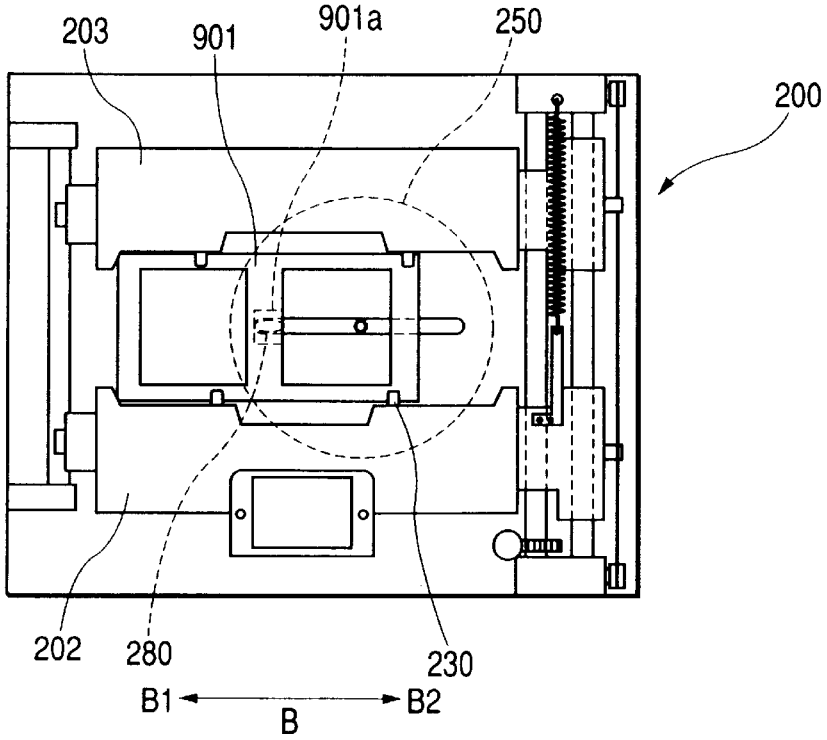

First, the control unit 150 drives the motor 257 to move the transversely movable supporting base 260 to a movement limit position in the rightward direction (in the B2 direction) in FIG. 12A (this movement limit position corresponds to a movement home position shown in FIG. 6). Further, a count value of the encoder 258 by this movement is cleared to be the original point. Next, the rotating base 250 is rotated by the motor 254 so that the direction in which the transversely movable supporting base 260 is moved (F direction) and the direction in which the transversely movable base 241 is moved (B direction) are set to be identical to each other. Subsequently, the transversely movable supporting base 260 is moved in the leftward direction (in the B1 direction) by the motor 257 until the feeler 280 abuts against the measurement groove 901*a*, and a value (number of pulses) outputted from the encoder 258 at this time is obtained. Subsequently, in the state in which the feeler 280 is kept in abutment against the measurement groove 901*a*, the transversely movable base 241 is moved in the leftward direction (in the B1 direction) by driving the motor 244 until the value of the encoder 258 obtained is returned to the original point. This causes the transversely movable supporting base 260 to be set at the movement home position (at the position shown in FIG. 12A).

In this case, by taking into consideration the effect of the backlash of the gear 258*a* and the rack 262 due to the difference in the direction in which the feeler 280 is pushed, it is also applicable that the transversely movable base 241 is moved until the value of the encoder 258 is returned to the value of the original point+a (the value before the original value by a predetermined number of pulses), that is, until the transversely movable supporting base 260 is set to be a position slightly before the movement home position.

Next, the linearity measurement is conducted as described below. While a predetermined driving torque is generated under control of the driving current to the motor 257 to hold the feeler 280 in abutment against the limiting plate 901, the transversely movable base 241 is moved rightward (in the B2 direction) by driving the motor 244. During this movement, the number of pulses of the motor 244 for moving the transversely movable base 241 is consecutively stored every time the value (number of pulses) outputted from the encoder 258 changes. Based on this procedure, a calibration table for the amount of movement of the transversely movable supporting base 260 with respect to the value of the encoder 258 is prepared.

The completion of measurement is determined as follows. In conjunction with the movement of the transversely movable base 241 in the rightward direction (in the B2 direction), the transversely movable supporting base 260 having the feeler 280 is moved leftward relative to the fixed block 256. When the transversely movable supporting base 260 reaches the movement limit position (the position shown in FIG. 12B) in the leftward direction (in the B1 direction), and further the transversely movable base 241 is moved in the rightward direction (in the B2 direction), the feeler 280 is released from the limiting plate 901, so that the value of the encoder 258 ceases to change. Based on this, the control unit 150 detects that measurement data over the entire stroke by which the transversely movable supporting base 260 is moved (the number of pulses of the motor 244 with respect to the value of the encoder 258) has been obtained, thereby finishing the linearity measurement.

The amount of movement of the transversely movable base 241 with respect to the number of pulses of the motor 244 is a known value obtainable from a design specification, namely from the pitch of the feed screw 245 and the amount of rotation of the feed screw corresponding to the number of pulses of the motor 244. Accordingly, if the number of pulses of the motor 244 is obtained, the amount of the movement of the transversely movable base 241, that is, the amount of movement of the transversely movable supporting base 260 with respect to the value of the encoder 258, is obtained. To prepare the calibration table, the control unit 150 converts the number of pulses of the motor 244 into an actual distance of movement, and stores the distance in a memory 151.

Since the calibration table for the amount of movement of the transversely movable supporting base 260 with respect to the value of the encoder 258 is prepared as described above, the calibration table is referred to during the actual measurement of the target lens shape. Accordingly, the target lens shape can be measured with high accuracy even though the measuring mechanism uses the rack and the pinion.

In the actual device, the calibration table stored in the memory (RAM) 151 may be stored in a nonvolatile memory 152 as it is, and may be used by being transferred to the memory 151 side during the starting of the device. To save the capacity of the memory, however, the following procedure may be taken, for example.

Figure 13:
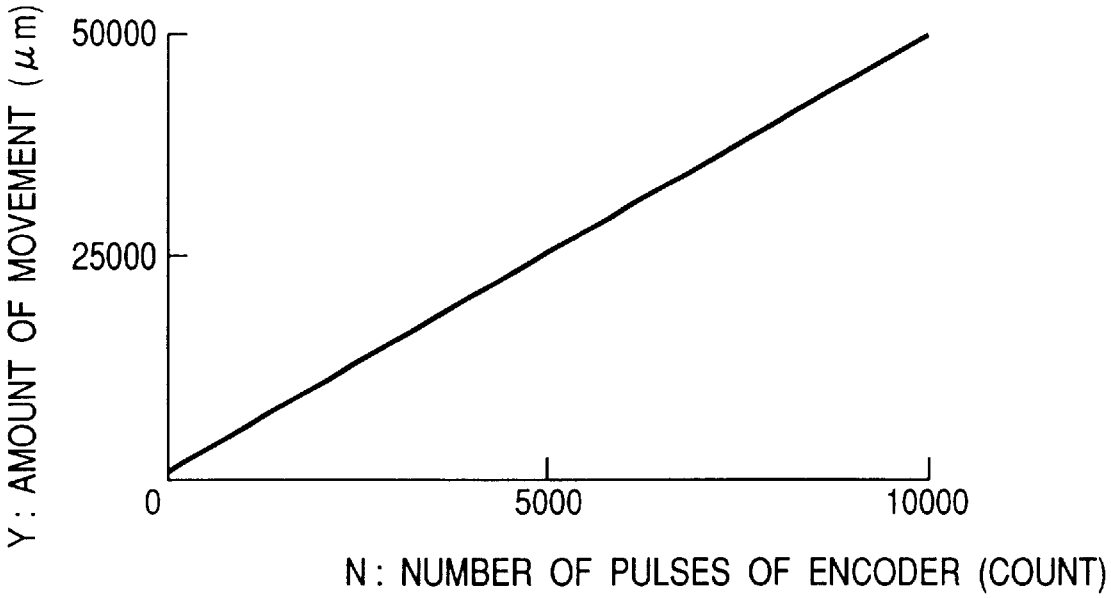
FIG. 13 is a diagram illustrating the relationship between the number of pulses of an encoder and the amount of movement determined from a pulse motor.

A relationship as shown in FIG. 13 stands between the number (N) of pulses of the encoder 258 and the amount (Y) of movement of the transversely movable supporting base 260 obtained from the motor 244 in the calibration table thus prepared. In FIG. 13, since the reduction ratio for the scale of the amount of movement of the transversely movable supporting base 260 obtained from the motor 244 is large, the periodically undulated change cannot be seen, but the data contains the undulation affecting the accuracy required for measurement. Here, the amount of movement, Y', which is linearly approximated in relation to the number of pulses, N, of the encoder 258 is first determined as $Y'=aN+b$ (a is a gradient, and b is an intercept)

Figure 14:
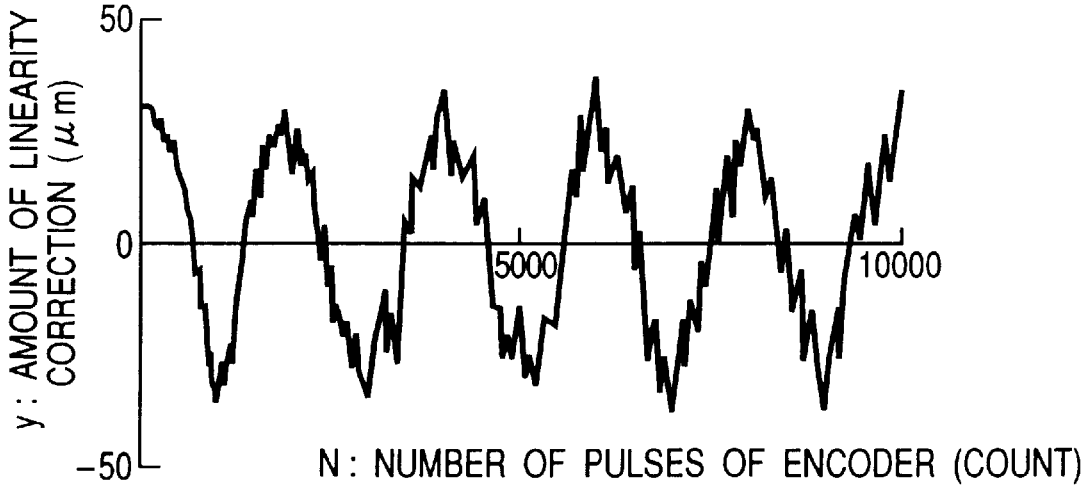
FIG. 14 is a diagram illustrating the relationship between the number of pulses of the encoder and the amount of linearity correction (raw data)

Next, through the calculation of $Y-Y'=y$, a new table is prepared, indicating the amount of linearity correction, y, in relation to number of pulses, N. This table is shown in FIG. 14. Using this table shown in FIG. 14, the amount of movement in the entire stroke with respect to the number of pulses, N, can be stored in the nonvolatile memory 152 with a smaller number of digits. That is, in place of the correction table shown in FIG. 13 having a larger number of digits, the correction table shown in FIG. 14 having a smaller number of digits and the formula $Y'=aN+b$ can be stored to reduce the capacity of the memory. When the device is started, the table of the amount of correction as shown in FIG. 13 is prepared again through calculation from the above formula for determining Y' and the table of the amount of linearity correction as shown in FIG. 14, and the thus prepared table is stored in the memory 151 for use in measurement.

Figure 15:
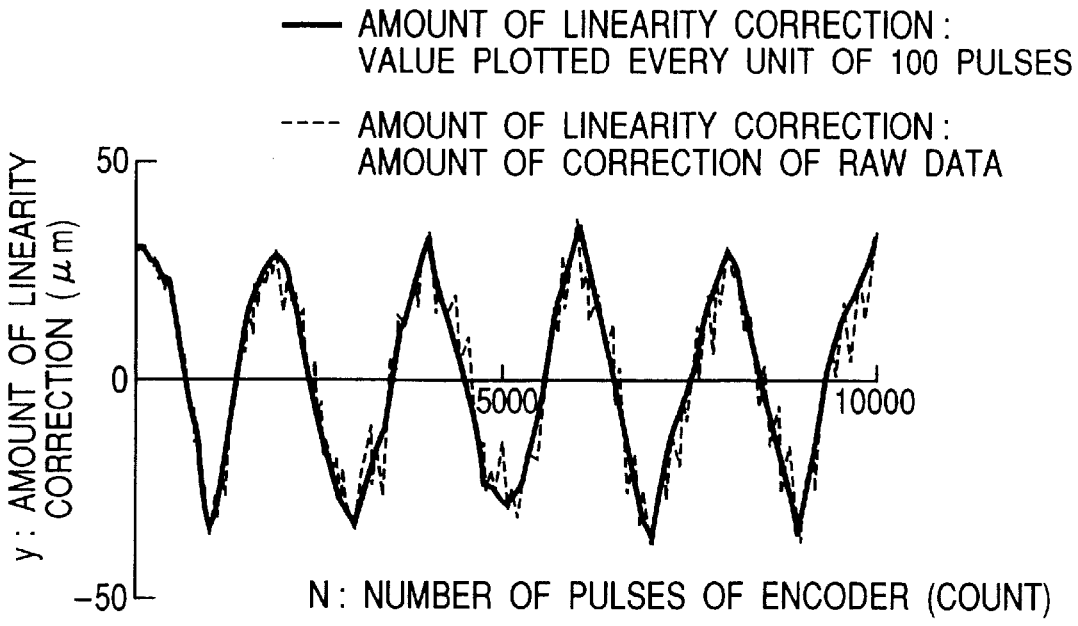
FIG. 15 is a diagram illustrating the relationship between the number of pulses of the encoder and the amount of linearity correction (linearly interpolated for a number of points)
Figure 16:
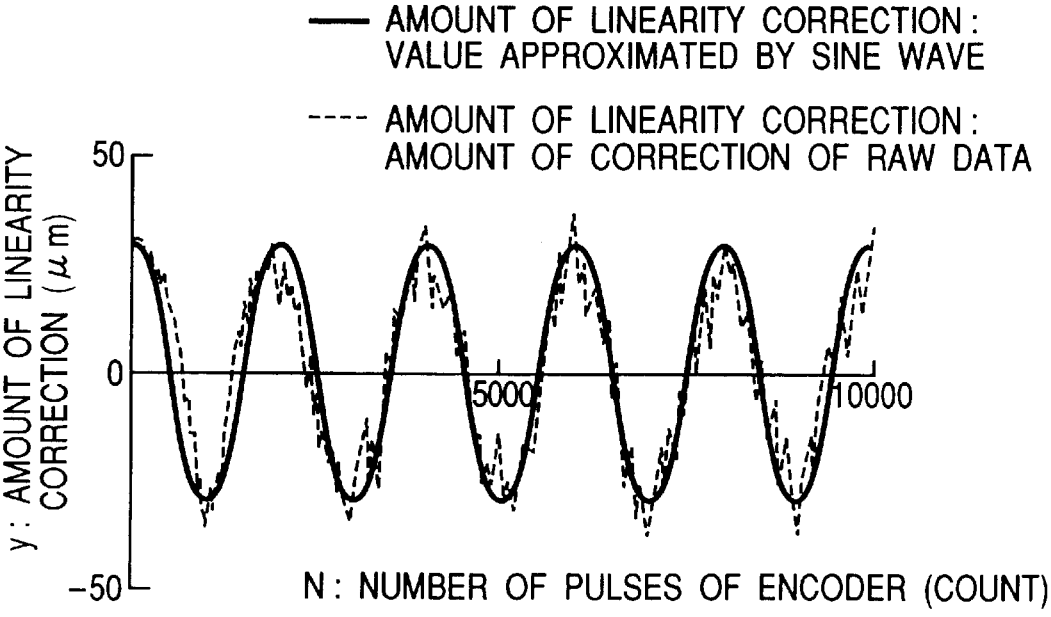
FIG. 16 is a diagram illustrating the relationship between the number of pulses of the encoder and the amount of linearity correction (approximated by a sine wave)

In order to further reduce the capacity of the memory, the amount of linearity correction y maybe approximated such that values in the amount of linearity correction y are intermittently stored at fixed intervals, i.e. every unit number of pulses (for example, every 100 pulses), and the rest of values between the adjacent stored values are linearly interpolated as shown by the solid line in FIG. 15. Furthermore, as shown in FIG. 16, if the amount of linearity correction y with respect to the number of pulses N is stored in the form of an arithmetic expression in which it is approximated by a sine wave, the memory capacity of the nonvolatile memory 152 can be saved even further. The way of obtaining and storing data is appropriately selected, taking into account the required level of accuracy.

Although the description has been given of the calibration using the feeler 280, the calibration using the measuring shaft 290 can be conducted similarly.

As described above, it is possible to conduct the linearity calibration with respect to the amount of movement of the lens shape feeler with high accuracy over a wide-ranging stroke using the mechanism provided in the device without using a special measuring instrument or jig. Accordingly, the target lens shape can be measured with high accuracy.

What is claimed is:

1. A target lens shape measuring device for measuring a target lens shape used to process an eyeglass lens, the device comprising:

holding means for holding a lens frame of an eyeglass frame, a template or a dummy lens in a predetermined state;

a holding base holding a feeler to be movable in a radius vector direction of the target lens shape;

first detecting means for detecting movement of the feeler in the radius vector direction;

arithmetic means for obtaining radius vector data of the target lens shape based on the detection result by the first detecting means;

moving means for relatively moving the holding base in the radius vector direction of the target lens shape with respect to the holding means;

second detecting means for detecting movement of the holding base by the moving means, the second detecting means being higher in detection accuracy than the first detecting means;

calibration means for obtaining and storing calibration data based on the detection result by the second detecting means during the movement of the holding base by the moving means, and calibrating the detection result by the first detecting means or arithmetic result by the arithmetic means based on the stored calibration data.

2. The device of claim 1, wherein the first detecting means includes a rack and a pinion for cooperatively converting linear motion of the feeler in the radius vector direction into rotational motion, and an encoder for detecting an amount of rotation of the pinion.

3. The device of claim 1, wherein the moving means includes a motor, and a threading mechanism for converting rotation motion by the motor into linear motion of the holding base in the radius vector direction.

4. The device of claim 3, wherein the second detecting means detects an amount of movement of the holding base based on rotation information of the motor.

5. The device of claim 1, wherein the moving means is used commonly as means for moving the feeler from a measurement center of the lens frame to a measurement center of another lens frame of the eyeglass frame to consecutively measure these lens frames.

6. The device of claim 1, further comprising:

an abutting member;

wherein the feeler is brought into abutment with the abutting member when the calibration data is obtained, and the moving means moves the holding base in a direction opposite from a direction in which the feeler is brought into abutment with the abutting member.

7. The device of claim 1, wherein the calibration means stores the detection result by the second detecting means during the movement of the holding base by the moving means as the calibration data for calibrating the detection result by the first detecting means or arithmetic result by the arithmetic means.

8. The device of claim 7, wherein the calibration means stores the calibration data in the form of a table.

9. The device of claim 7, wherein the calibration means stores the detection result by the second detecting means during the movement of the holding base in a predetermined distance by the moving means and an arithmetic formula interpolating the detection result as the calibration data.

10. The device of claim 1, wherein the calibration means obtains correction data based on the detection results by the first and second detection means during the movement of the holding base by the moving means, and stores the correction data as the calibration data for calibrating the detection result by the first detecting means or arithmetic result by the arithmetic means.

11. The device of claim 10, wherein the calibration means stores the correction data in the form of a table.

12. The device of claim 10, wherein the calibration means stores the correction data based on the detection results by the first and second detection means during the movement of the holding base in a predetermined distance by the moving means, and an arithmetic formula interpolating the correction data as the calibration data.

13. The device of claim 1, wherein the holding base includes:

a transversely movable supporting base which holds the feeler;

a rotating base which holds the transversely movable supporting base to be movable in the radius vector direction; and a transversely movable base which holds the rotating base to be rotatable.

14. The device of claim 13, wherein the first detecting means detects movement of the transversely movable supporting base as the movement of the feeler in the radius vector direction; and the second detecting means detects movement of the transversely movable base as the movement of the holding base in the radius vector direction.

15. The device of claim 1, wherein the holding base holds the feeler to be movable in the radius vector direction and in a direction perpendicular to the radius vector direction.

16. The device of claim 15, wherein the holding base includes:

a vertically movable supporting base which holds the feeler;

a transversely movable supporting base which holds the vertically movable supporting base to be movable vertically;

a rotating base which holds the transversely movable supporting base to be movable in the radius vector direction; and a transversely movable base which holds the rotating base to be rotatable.

17. An eyeglass lens processing apparatus, provided with the target lens shape measuring device of claim 1, for processing the eyeglass lens based on the obtained target lens shape, the apparatus comprising:

lens processing means having a rotatable abrasive wheel, and a lens rotating shaft holding and rotating the lens; and control means for controlling the lens processing means based on the obtained target lens shape.

* * * * *